United States Patent [19]

Daunheimer

[11] Patent Number: 4,771,687

[45] Date of Patent: Sep. 20, 1988

[54] BELT TRANSFER PRINTING OF NONPLANAR ARTICLES

[75] Inventor: Lyn R. Daunheimer, Batavia, Ill.

[73] Assignee: USG Corporation, Chicago, Ill.

[21] Appl. No.: 948,065

[22] Filed: Dec. 31, 1986

[51] Int. Cl.[4] ..... B41F 17/00

[52] U.S. Cl. ..... 101/44; 101/126; 101/129

[58] Field of Search ..... 101/129, 35, 212, 41, 101/44, 114, 126

[56] References Cited

U.S. PATENT DOCUMENTS

| | | | |
|---|---|---|---|
| 887,315 | 5/1908 | Deidrick . | |
| 1,989,375 | 1/1935 | Meyercord | 101/177 |
| 2,124,711 | 7/1938 | Rowell | 101/41 |
| 2,202,465 | 5/1940 | Pattison | 101/41 |
| 2,280,414 | 4/1942 | Koppinger | 101/175 |
| 2,419,694 | 4/1947 | Shuttleworth et al. | 101/129 |
| 2,904,916 | 9/1959 | Stahmann | 41/1 |
| 3,221,648 | 12/1965 | Weiss | 101/129 |
| 3,276,358 | 10/1966 | Lusher | 101/129 |
| 3,404,624 | 10/1968 | Proffitt, Jr. | 101/129 X |
| 3,418,926 | 12/1968 | Hakogi | 101/35 |
| 3,868,901 | 3/1975 | Valiela | 101/41 |
| 3,871,293 | 3/1975 | Valiela | 101/41 |
| 3,990,364 | 11/1976 | Paans | 101/129 |
| 4,098,184 | 7/1978 | Okada | 101/41 |
| 4,388,866 | 6/1983 | Nakanishi | 101/426 |

FOREIGN PATENT DOCUMENTS

| | | | |
|---|---|---|---|
| 374195 | 6/1932 | United Kingdom | 101/129 |

*Primary Examiner*—Clifford D. Crowder

*Attorney, Agent, or Firm*—A. Lewis Worthem, Jr.; Robert H. Robinson; Robert M. Didrick

[57] ABSTRACT

Apparatus and method for belt transfer printing of nonflat surfaces of porous articles wherein the printing of the article by a first region of the belt is carried out substantially simultaneously with the inking of a second region of the belt. In a preferred embodiment, the apparatus comprises an endless belt with a screen printing device disposed along a first run of the belt and a vacuum workpiece support box disposed along a second run of the belt with an opposed sealing frame. A workpiece is loaded in the vacuum box, a vacuum is created through the workpiece to draw a pattern carrying region into printing contact with the workpiece surface while another pattern is being inked onto a second region of the belt. The workpiece is replaced with a second workpiece and the second region of the belt is advanced into registration with the second workpiece.

6 Claims, 2 Drawing Sheets

BELT TRANSFER PRINTING OF NONPLANAR ARTICLES

BACKGROUND OF THE INVENTION

1. Field of the Invention

This invention relates to the art of printing, and, more particularly, to an apparatus and method for belt transfer printing of inked patterns onto nonflat surfaces of porous workpieces.

2. The Prior Art

It is often desired to print a design on the surface of a workpiece. Difficulties may arise when the workpiece surface to be printed includes significant nonplanar regions. An example of such a workpiece is a molded hardboard doorskin such as is manufactured and sold by the Masonite Corporation under the trademark "Colonist". This doorskin has much of its surface significantly recessed and embossed to simulate the form and texture of natural wood architectural millwork. The simulation may be further enhanced by printing the surface of the doorskin with a wood grain pattern. The pattern must be properly registered with the workpiece to correspond with the three-dimensional features of the workpiece.

Conventional printing devices such as press platens and gravure cylinders will generally be incapable of conforming and printing to a nonflat surface. Prior art methods of printing to such surfaces include use of an elastic transfer member. For example, U.S. Pat. No. 2,904,916 discloses a printing apparatus wherein a design is first screened onto a rubber transfer mat. The workpiece, of a porous material, is placed in a support. The mat is sealed over the workpiece and vacuum produced through the support draws the mat into contact with the workpiece, thus transferring the design to the workpiece surface.

In U.S. Pat. No. 2,202,465 there is disclosed a printing apparatus wherein the transfer member is an endless elastic belt. An inked plate is positioned below the belt, then the belt is momentarily pressed against the plate. The plate is then removed. A nonflat workpiece is positioned below the belt, then the belt is pressed into contact with the workpiece by pressure from above. After printing of the workpiece, the belt is advanced through a cleaning bath.

In these and other approaches of the prior art in which a transfer member is used to print a registered pattern on a three dimensional workpiece, the inking of the transfer member and the printing of the workpiece are sequential steps. That is, while the transfer member is receiving the pattern it is unavailable for printing to the workpiece, and vice versa. The throughput of such approaches is therefore significantly limited by the necessity of waiting for the inking of the transfer member before the workpiece can be printed.

What has been lacking is an apparatus and method for registered transfer printing wherein the transfer member is simultaneously available for receiving a pattern and for printing the pattern to the workpiece.

SUMMARY OF THE INVENTION

The present invention satisfies the aforementioned lack by providing an apparatus and method for registered transfer printing of a nonplanar surface of a gas permeable workpiece using an endless transfer belt and two discrete stations for inking a pattern onto the belt and for transferring the pattern to the workpiece surface. The inking and transferring operations are carried on substantially simultaneously.

According to a preferred embodiment of the invention, an endless, elastic transfer belt is disposed horizontally with an upper first run and a lower second run. Screen printing apparatus is disposed along the first run. The screen is used to deposit an inked patter on a region of the outer surface of the belt. After the belt receives the pattern, the inked region is advanced to the second run. A workpiece support device is situated below the second run of the belt. The support device is in the form of a vacuum box having an upper surface shaped to uniformly support the underside or nonprinted surface of the workpiece so that the surface to be printed is held in generally parallel, spaced, confronting relationship with the inked region of the belt. The upper surface of the vacuum box support is provided with apertures in sufficient number to distribute a vacuum from within the box through the thickness of the workpiece. With the workpiece in place on the vacuum box and the inked region of the belt over the box, a sealing frame above the inked region is brought down to seal the perimeter of the inked region against the perimeter of the vacuum box. Vacuum imposed in the vacuum box draws the belt region into intimate contact with the entire surface of the workpiece and prints the pattern onto the workpiece. While the pattern is being printed onto the workpiece, a second, discrete region of the belt is being substantially simultaneously inked on the first run of the belt. After printing of the workpiece is complete, the vacuum is released, the workpiece is removed from the vacuum box and replaced with a second workpiece, and the second pattern carrying region of the belt is advanced into position above the second workpiece. This process is repeated continuously. Thus, there is no necessity of waiting for reinking of the belt before the second workpiece may be printed.

According to other features of the preferred embodiment, means are provided for detecting the position of the belt to attain proper registered positioning of the belt regions with respect to the workpieces. Conveyor devices are provided for transporting the workpieces to and from the vacuum box. Furthermore, belt cleaning devices are provided for preparing the belt surface for receiving the inked pattern.

DESCRIPTION OF THE PREFERRED EMBODIMENT

Figure 1:
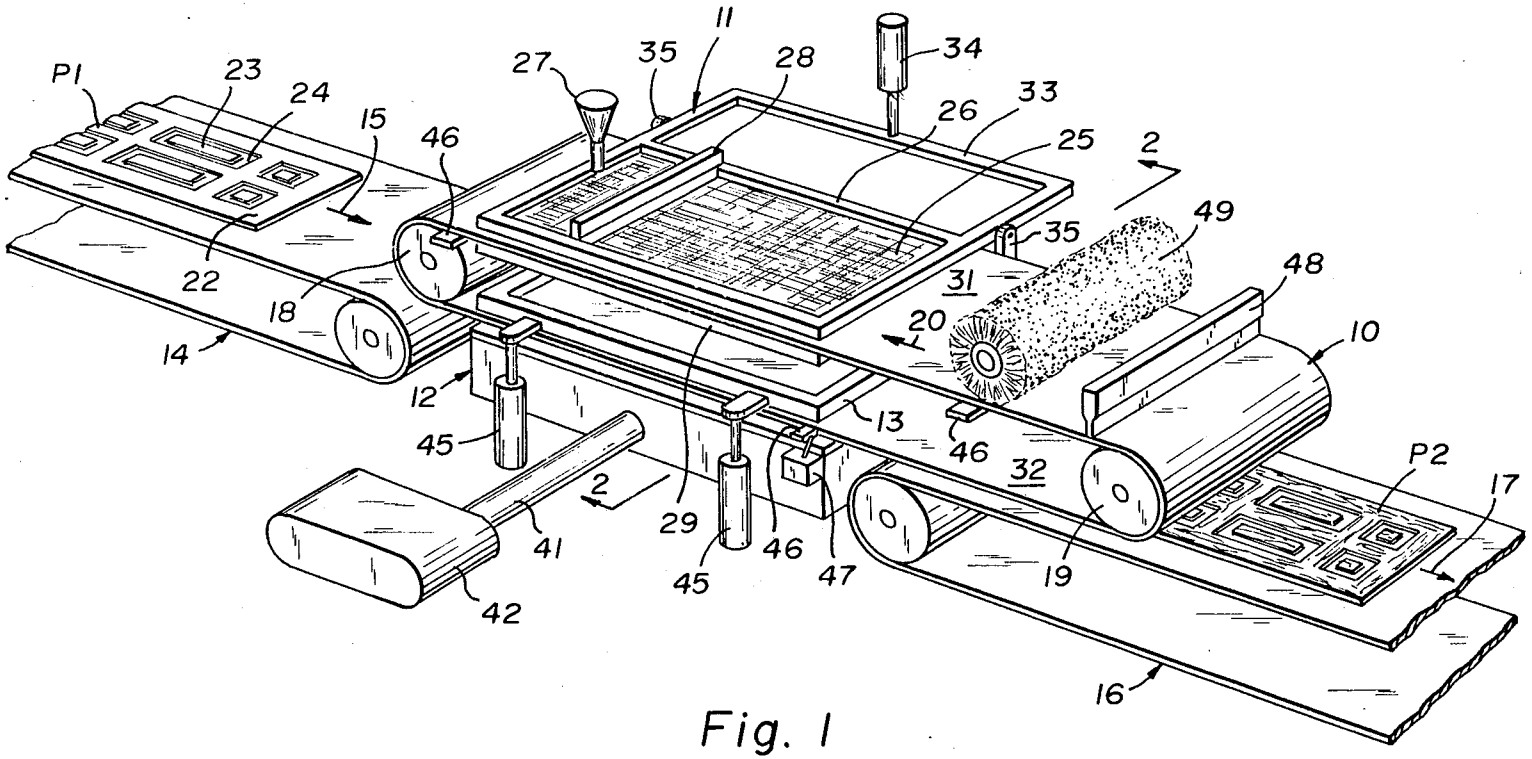
FIG. 1 is end and side perspective view illustrating a preferred embodiment of the invention being used to print the surface of a molded hardboard doorskin panel.
Figure 2:
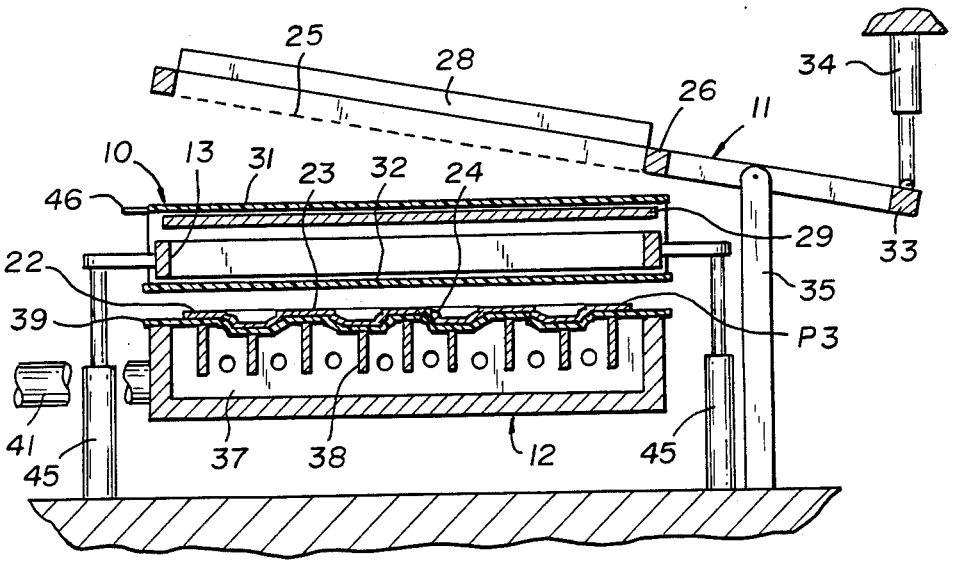
FIG. 2 is a fragmentary, end sectional view taken substantially along the line 2—2 of FIG. 1 with the screen and sealing frame in the open, nonprinting positions.

By way of disclosing a preferred embodiment of the invention, and not by way of limitation, there is shown in FIG. 1, a belt transfer printing apparatus being used to print a wood grain pattern on molded hardboard doorskin panels P1, P2 (and P3, FIG. 2). In its general organization, the apparatus includes an endless transfer belt 10, a screen printing device 11, a vacuum support box 12, and a sealing frame 13. Workpiece conveyor 14 is provided for transporting unprinted panel P1 to the printing apparatus as indicated by arrow 15. Workpiece conveyor 16 is provided for transporting printed panel P2 away from the printing apparatus as indicated by arrow 17.

The workpiece panels P1, P2 are each formed of compressed wood fibers and have sufficient gas permeability to conduct a vacuum through their thickness. Referring additionally to FIG. 2, it may be seen that the panels have laterally and longitudinally extending nonplanar surfaces with substantially planar areas 22, 23 and significantly recessed and irregularly shaped areas 24. In addition, the entire surface of the panels may be embossed with a wood-like texture. To more fully simulate the appearance of a door constructed of individually cut and formed pieces of wood, it is desirable to print a grain or shading pattern on the panels which is oriented in lateral and longitudinal grain directions and which is properly registered to the planar and recessed areas.

The transfer belt 10 is disposed generally horizontally, driven by rolls 18, 19 in the direction indicated by arrow 20. In this configuration, the belt 10 comprises an upper, first run 31 and a lower, second run 32. The transfer belt is advantageously made of silicone rubber, a material which will temporarily carry an inked pattern yet which will readily release the ink to the workpiece surfaces.

The screen printing device 11, disposed in generally parallel relationship to the first run 31, includes, as is well known in the art, a screen 25 held in a frame 26, an inker 27, a squeegee 28, and a platen 29. The frame 26 includes a laterally outwardly extending member 33 connected to the rod of cylinder 34. The frame is pivotably connected to supports 35 such that extension and retraction of the rod of cylinder 34 causes the screen to be raised from and lowered against the belt 10.

In operation, a region of the belt is advanced into position beneath the screen 25. The screen is lowered by retraction of cylinder 34 into the position shown in FIG. 3. Ink is deposited on the screen by device 27. The ink is spread through the pattern bearing screen by squeegee 28 with a supporting force provided by platen 29, thereby depositing an inked pattern on a region of the outer surface of belt 10. Cylinder 34 then extends, thereby raising the screen into the position shown in FIG. 2 and freeing the belt to be advanced. If desired, means may be provided (not shown) for automatic control of the movements and functions of the apparatus.

As shown in FIG. 2, the vacuum box 12 is placed below, spaced apart from, and generally parallel with the lower, second run 32 of the belt 10. The interior of the box is generally hollow, with an array of apertured interior baffles 37, 38 provided to strengthen and rigidify the box. The vacuum box includes a top plate 39 which is contoured to generally conform to the shape of the underside of the supported panel P3. The top plate 39 is further provided with many apertures distributed throughout its area for imposing vacuum on the underside of the panel P3. A duct 41 is in fluid communication with the interior of the vacuum box and with a source of vacuum such as blower 42 (FIG. 1).

As shown in FIGS. 1 and 2, a sealing frame 13 is provided disposed between the first and second runs 31, 32 of the belt. The sealing frame is generally parallel to and coextensive with the perimeter of the top plate 39 of the vacuum box 12. The sealing frame is supported at its opposite lateral sides by four cylinders 45.

Figure 3:
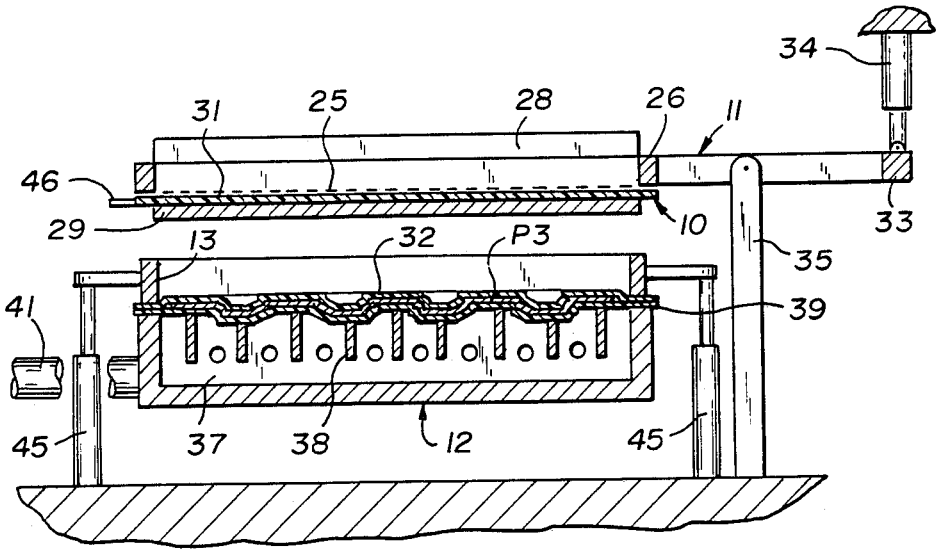
FIG. 3 is a fragmentary, end sectional view similar to FIG. 2, but with the screen and sealing frame in the closed, printing positions.

In operation, an inked, pattern bearing region of the belt is brought into registered position above a panel P3 loaded on the top plate of the vacuum box. Next, the cylinders 45 are actuated to lower the sealing frame 13. The frame presses against a rectangular portion of the belt bounding the pattern carrying region and effects a substantially gastight seal of the belt to the perimeter of the top plate 39. A vacuum is then created in the vacuum box which, through the permeable workpiece P3, draws the belt into intimate printing contact with the workpiece surface, as illustrated in FIG. 3. Advantageously, the printing of the workpiece is carried out substantially simultaneously with the inking of a second region of the belt above.

As a means of registering the inked patterns on the belt regions properly with the workpieces, lugs 46 are provided at spaced intervals along an edge of the belt 10 corresponding to the number and spacing of pattern carrying regions of the belt. A sensing switch 47 is fixed to the vacuum box 12 for detecting the incidence of the lugs. Signals caused by the switch may be used in conjunction with suitable control devices to start and stop the belt, raise and lower and print through the screen 25, raise and lower the sealing frame 13, start and stop the vacuum blower 42, and load and remove workpieces onto and from the vacuum box 12.

Referring again to FIG. 1, there is shown an optional vacuum cleaning device 48 and a wiping roller 49 disposed laterally across the upper run of the belt 10. Such devices may be provided for removing excess ink from the belt and preparing regions of the belt for receiving freshly inked patterns.

The operation of the apparatus may be summarized as follows: With sealing frame 13 in the raised, open position, a workpiece is advanced on conveyor 14 and placed upon the top plate 39 of vacuum box 12. A previously inked, pattern bearing region of belt 10 is in registered position above the workpiece. The sealing frame is lowered against the belt by actuation of cylinders 45. A vacuum is created in the vacuum box 12 and the belt is drawn downward to transfer the inked pattern to the workpiece. Substantially simultaneously with the printing of the workpiece, cylinder 34 is actuated to lower the screen frame 26 to bear against a second region of the belt 10 and platen 29. Ink is deposited on the screen 25 by inking device 27. Squeegee 28 then travels longitudinally to spread the ink and deposit a pattern on the second region of the belt. The vacuum is then released, sealing frame 13 is raised, and screen frame 26 is also raised. The workpiece is then removed from the vacuum box 12 and is carried away by conveyor 16. The belt 10 advances until a succeeding lug 46 contacts switch 47. During advancement of the belt, cleaning devices 48 prepare regions of the belt for reinking. Another workpiece is loaded into the vacuum box and process is repeated.

While the invention has been disclosed with reference to a preferred embodiment, it it is understood that the inventioned may be practiced in various modifications and orientations without departing from the scope of the claims which follow.

What is claimed is:

1. Apparatus for belt transfer printing of a nonplanar surface of a gas permeable panel workpiece of lateral and longitudinal extent comprising:

an endless, elastic, continuously flexible transfer belt having a plurality of regions on its outer surface capable of temporarily carrying an inked pattern and transferring said pattern to said workpiece surface, said belt having a first run and a second run spaced apart from and opposite said first run, said belt thereby defining a first zone disposed between said first run and said second run and a second zone without said first zone;

printing means disposed in said second zone along said first run and adapted to deposit said inked pattern on said belt regions;

stationary workpiece support means disposed in said second zone and in generally parallel, spaced, confronting relationship with said second run and adapted for uniform support of the underside of said workpiece and for imposing and releasing a partial vacuum through said workpiece;

means for intermittently advancing said belt regions from said first run to said second run to a position disposed in confronting, registered relationship with the nonplanar surface of a workpiece on said support means; and means disposed within said first zone in opposing relationship to said workpiece support means for sealing and releasing the confronting regions of said belt in substantially gastight relationship with said workpiece support means and said workpiece surface, whereby vacuum imposed by said support means draws said belt into intimate, uniform printing contact with said nonplanar surface.

2. The apparatus of claim 1 wherein said printing means comprising a screen printing device.

3. The apparatus of claim 1 wherein said workpiece support means comprises a vacuum box having a top plate shaped to conform to the underside of said workpiece.

4. The apparatus of claim 1 further including automatic control means operatively associated with said belt for positioning said belt in said registered relationship and for actuating said printing means, said sealing vacuum means and said partial vacuum.

5. The apparatus of claim 1 further comprising belt cleaning means disposed adjacent said belt.

6. A method for endless, elastic, continuously flexible belt transfer printing of a nonplanar surface of a gas permeable panel workpiece of lateral and longitudinal extent comprising the steps of:

inking a pattern onto a first region along a first run of the belt;

intermittently advancing said first region of the belt to a second run thereof spaced apart from said first run generally parallel to and opposite said first run into registration with a workpiece supported on a vacuum support in spaced, confronting relationship with said second run while advancing a second region of the belt into position for inking of a second region of the belt;

pressing a sealing frame disposed between said first run and said second run against said first region thereby sealing said first region in substantially gastight relationship with said workpiece and said vacuum support;

creating a partial vacuum in said vacuum support to draw said first region into intimate, uniform printing contact with said workpiece while said step of inking is substantially simultaneously conducted on said second region;

unsealing and removing the workpiece from said vacuum support and loading a second workpiece onto said vacuum support; and returning to said step of advancing.

* * * * *